US006786566B2

(12) United States Patent
Shindo

(10) Patent No.: US 6,786,566 B2
(45) Date of Patent: Sep. 7, 2004

(54) INK JET RECORDING APPARATUS

(75) Inventor: Tatsuya Shindo, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/314,640

(22) Filed: Dec. 9, 2002

(65) Prior Publication Data

US 2003/0112286 A1 Jun. 19, 2003

(30) Foreign Application Priority Data

Dec. 17, 2001 (JP) ..... 2001-382857

(51) Int. Cl.[7] ..... B41J 2/165

(52) U.S. Cl. ..... 347/30; 347/23; 347/29; 347/7; 347/35

(58) Field of Search ..... 347/30, 14, 22, 347/23, 24, 29, 35, 7, 10, 11, 92

(56) References Cited

U.S. PATENT DOCUMENTS 5,606,353 A 2/1997 Mochizuki et al.
6,174,042 B1 * 1/2001 Kobayashi et al. ..... 347/23

FOREIGN PATENT DOCUMENTS

JP 2564833 B2 1/1989
JP 3233175 B2 9/1994
JP 9-262990 10/1997
JP 10-24604 1/1998

* cited by examiner

*Primary Examiner*—Shih-wen Hsieh
(74) *Attorney, Agent, or Firm*—Reed Smith LLP

(57) ABSTRACT

An ink jet recording apparatus changes ink suction forces of a purge device according to amounts of ink remaining in an ink cartridge. As it is determined that the amount of ink remaining in the ink cartridge is less than a predetermined amount for a purge operation, second pulse signals which output the smaller number of pulses than first pulse signals, are output to a line feed motor. Accordingly, high viscous ink is sucked from nozzles by a suction pump with a weaker suction force than that when the remaining amount of ink in the ink cartridge is equal to or greater than the predetermined amount. Therefore, even when the amount of ink remaining in the ink cartridge is less than the predetermined amount, that is, when a considerable amount of air is contained in the ink cartridge, the purge operation can be performed without the air being pulled into the ink jet print head by the suction force of the suction pump. Consequently, ink can be stably ejected for subsequent print operation.

23 Claims, 3 Drawing Sheets

INK JET RECORDING APPARATUS

BACKGROUND OF THE INVENTION

1. Field of the Invention

The invention relates to an ink jet recording apparatus, and, more particularly, to an ink jet recording apparatus that stably ejects ink.

2. Description of the Related Art

In a known ink jet recording apparatus, such as a color ink jet printer, an ink tank that stores ink therein and an ink jet print head that ejects ink stored in the ink tank onto a recording medium are mounted on a carriage. The carriage mounting thereon the ink tank and the ink jet print head is reciprocated in a main scanning direction to perform printing onto the recording medium. Such color ink jet printer performs a purge operation which is generally performed to remove air in an ink passage in order to prepare the print head for printing when an ink tank is mounted on an ink jet printer, as well as to remove dried ink or foreign materials clogging nozzles of the print head and causing improper ink ejection. When the purge operation is performed in the latter case using a relatively strong suction force, air existing above the level of the ink in the ink tank might be sucked along with the ink, especially when an amount of the ink in the ink tank is small.

When the purge operation is performed, a substantially box-shaped purge cap makes contact with the ink ejection surface of the ink jet print head having the nozzles thereon, forming an enclosed space. Pressures in the enclosed space are reduced using a suction pump connected to the purge cap. The high viscous ink or air is sucked from the nozzles and discharged from a discharge port formed on the purge cap.

The suction pump used in a known ink jet printer for the purge operation is controlled such that the high viscous ink or air is sucked with relatively strong suction force, to recover from relatively poor ink ejection conditions. If the high viscous ink or air is sucked with such strong force when only a small amount of ink is present in the ink tank, that is, when considerable amount of air is contained in the ink tank, the air in the ink tank may be sucked by the strong force of the suction pump toward the ink jet print head. This may cause unstable ink ejection in a subsequent print operation.

An ink jet recording apparatus disclosed in, for example, Japanese Patent Publication No. 2,564,833 includes a detector that detects a condition that ink in an ink tank is about to run out and outputs a signal indicating such condition. After the detector outputs the signal, a purge command signal is not output to a controller that carries out a purge operation. In this case, however, the ink tank has to be replaced even though the ink tank has some ink left therein.

SUMMARY OF THE INVENTION

Accordingly, one aspect of the invention is to provide an ink jet recording apparatus that performs a purge operation without drawing air into an ink jet print head and that continues a print operation even when an amount of ink remaining in an ink tank is small in order to extend the life of the ink tank.

An ink jet recording apparatus according to the invention may include an ink tank that stores ink, an ink jet print head that performs recording onto a recording medium by ejecting the ink stored in the ink tank, the ink jet print head having an ink ejection surface on which nozzles are formed, a purge device that recovers an ink ejection condition by sucking the ink from the nozzles formed on the ink ejection surface, a remaining ink amount detection device that detects a remaining ink amount in the ink tank, and a suction force changing device that changes an ink suction force of the purge device according to the remaining ink amount detected by the remaining ink amount detection device.

In one aspect, the ink jet recording apparatus of the present invention may change the ink suction force of the purge device according to the remaining ink amount, so that a proper ink ejection condition may be restored with a relatively low ink suction force.

BRIEF DESCRIPTION OF THE DRAWINGS

An embodiment of the invention will be described in detail with reference to the following figures wherein.

DETAILED DESCRIPTION OF EMBODIMENTS

Figure 1:
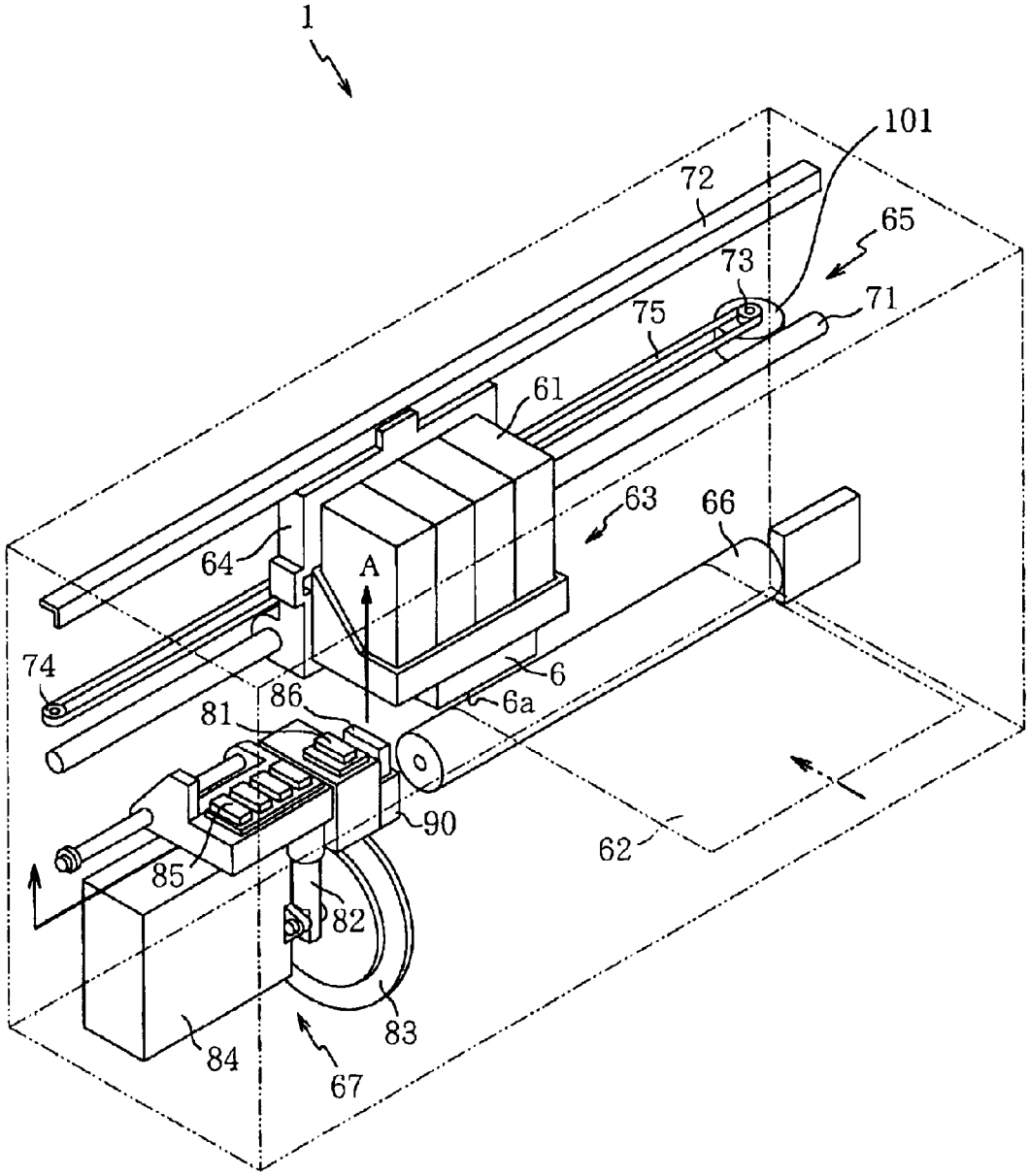
FIG. 1 is a perspective view of a color ink jet printer according to an embodiment of the invention.

An ink jet recording apparatus according to an embodiment of the invention will be described. FIG. 1 is a perspective view of a color ink jet printer 1, as the ink jet recording apparatus. In FIG. 1, the color ink jet printer 1 includes, for example, four ink cartridges (ink tanks) 61, each of which store one of cyan, magenta, yellow, and black ink, a print head unit 63 including an ink jet print head 6 for ejecting the ink onto a paper sheet 62, a carriage 64 that mounts thereon the ink cartridges 61 and the print head unit 63, a drive unit 65 that linearly reciprocates the carriage, a platen roller 66 that extends in moving directions of the carriage 64 and is disposed so as to face the ink jet print head 6, and a purge device 67.

The drive unit 65 includes a carriage shaft 71 that extends parallel to the platen roller 66 and is disposed on a lower end portion of the carriage 64, a guide plate 72 that extends parallel to the carriage shaft 71 and is disposed on an upper end portion of the carriage 64, pulleys 73, 74 disposed between the carriage shaft 71 and the guide plate 72 on each end side of the carriage shaft 71, and an endless belt 75 that is wound around the pulleys 73, 74.

As the pulley 73 is rotated in the forward or reverse direction by a carriage (CR) motor 101, the carriage 64 connected to the endless belt 75 linearly reciprocates along the carriage shaft 71 and the guide plate 72.

The ink jet print head 6 is formed into a substantially rectangular shape and provided on a lower part of the print head unit 63. Provided on the lower side of the print head 6 is an ink ejection surface 6*a* on which a plurality of nozzles are formed. Four rows of nozzles are provided on the ink ejection surface 6*a* in association with four ink colors. Each color of ink is ejected from a predetermined nozzle row. The ink ejection surface 6*a* is provided vertical to the platen roller 66 disposed therebelow and substantially parallel to the moving directions of the carriage 64.

Figure 2:
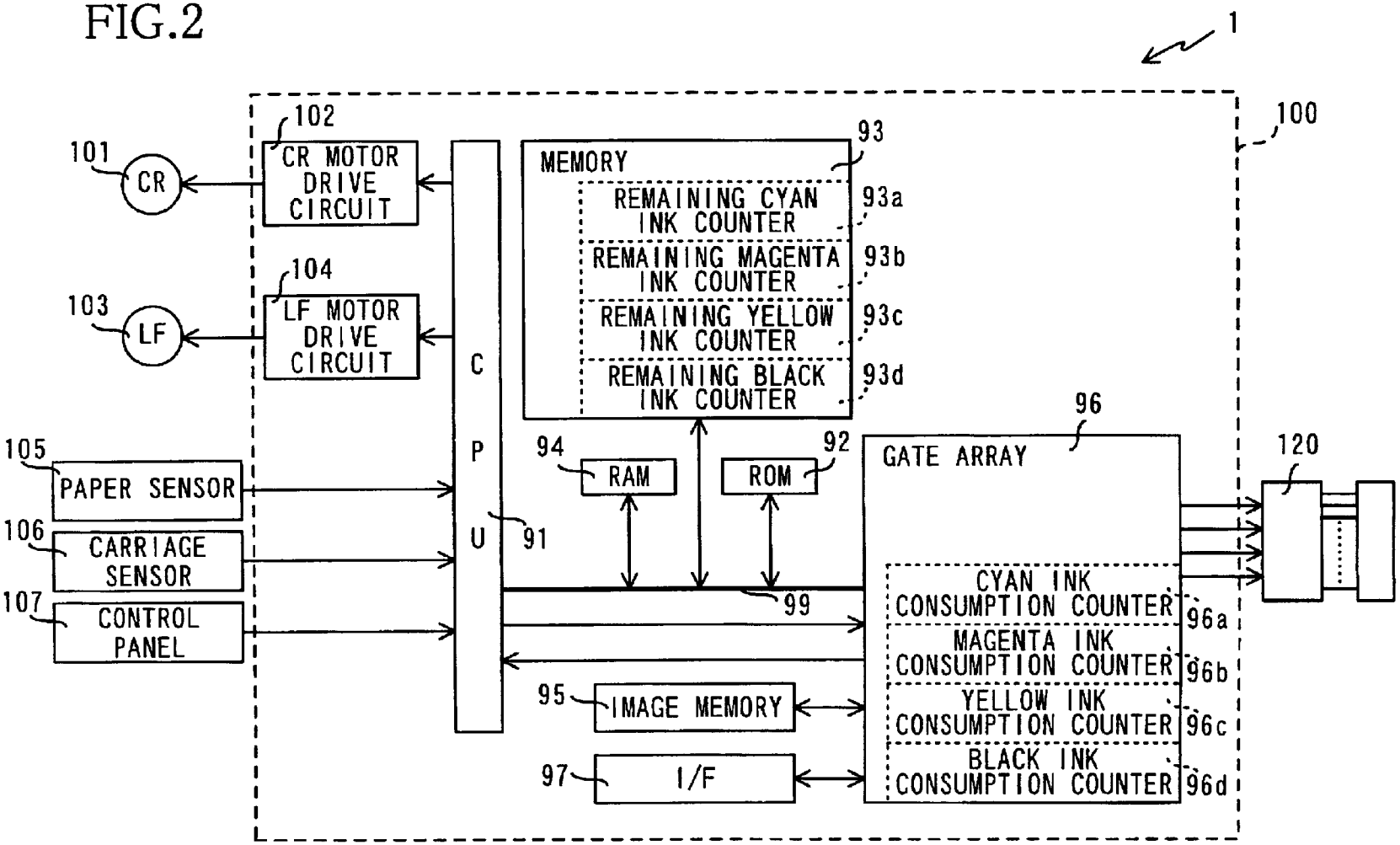
FIG. 2 is a block diagram illustrating an electrical configuration of the ink jet printer.

The paper sheet 62 is supplied from a paper cassette (not shown) provided in the color ink jet printer 1 and fed by a line feed (LF) motor 103 (shown in FIG. 2). The paper sheet 62 passes between the ink ejection surface 6*a* of the print head 6 and the platen roller 66. Printing is performed by ejecting the color ink onto the paper sheet 62 from the nozzles formed on the ink ejection surface 6*a*. Thereafter, the paper sheet 62 is discharged. The sheet feeding and discharging mechanisms are not illustrated in FIG. 1.

The purge device 67 is disposed to an end side of the platen 66. The purge device 67 performs a purge operation to remove high viscous ink clogging the nozzles and air, so that favorable ink ejection conditions can be resumed. The purge device 67 is disposed so as to face the ink jet print head 6 when the print head unit 63 is in the purge executing position. The purge device 67 includes a purge cap 81, a suction pump 82, a cam 83, and a waste ink reservoir 84.

The purge cap 81 is moved up and down in the direction of an arrow A and its opposite direction by the rotation of the cam 83. The purge cap 81 is shaped in a substantially box opening upwardly toward the ink ejection surface 6*a* of the ink jet print head 6, so that, when the purge cap 81 contacts the ink ejection surface 6*a*, an enclosed space is defined thereby. The purge cap 81 has a discharge opening (not shown) on a bottom surface thereof. The discharge opening is connected to the suction pump 82. To operate the suction pump 82, the cam 83, which is driven by the LF motor 103 (shown in FIG. 2), is selectively rotated through a connecting mechanism. The rotation of the cam 83 causes a piston in the suction pump 82 to reciprocate. Thus, the suction pump 82 is operated. While the cam 83 rotates once, the suction pump 82 reduces pressure in the space enclosed by the purge cap 81 and the ink ejection surface 6*a* to remove high viscous ink or air from the nozzles formed in the ink ejection surface 6*a*. The waste ink reservoir 84 is disposed adjacent to the suction pump 82. The waste ink reservoir 84 is formed into a substantially box shape. The ink sucked by the purge operation is stored in the waste ink reservoir 84 by the suction pump 82, through the purge cap 81.

A wiping member 86 is disposed to one side of the purge cap 81 near an end of the platen roller 66. The wiping member 86 moves relative to the ink jet print head 6. A cap 85, which will be described in detail below, is disposed above the waste ink reservoir 84 at the other side of the purge cap 81.

The wiping member 86 wipes off the ink adhered during the purge operation to the ink ejection surface 6*a*. The wiping member 86 is formed of elastic material, such as ethylene-propylene rubber, into a substantially plate shape. An end of the wiping member 86 is held by a wiper holder 90. A wiping operation for wiping off the ink on the ink ejection surface 6*a* with the wiping member 86 is performed by raising the wiping member 86 in the direction of the arrow A by the rotation of the cam 83. An ink repellant treatment is applied to the ink ejection surface 6*a*, to readily wipe off the ink thereon.

The cap 85 covers the ink ejection surface 6*a* by contacting thereto in a reset position where the carriage 64 mounting thereon the ink jet print head 6 is moved after printing is finished. The cap 85 includes four protruding portions formed into a substantially rectangular shape. The four protruding portions are disposed in positions opposite to the four nozzle rows when the carriage 64 is in the reset position. Each of the four protruding portions covers one of four nozzle rows, preventing the ink in the nozzles from evaporating and drying.

FIG. 2 is a block diagram illustrating an electrical configuration of the color ink jet printer 1. A controller that controls the color ink jet printer 1 includes a control substrate 100 of a main body side and a carriage substrate 120. The control substrate 100 includes a one-chip microcomputer (central processing unit or CPU) 91, a read-only memory (ROM) 92, a memory 93, a random-access memory (RAM) 94, an image memory 95, and a gate array 96.

The CPU 91 controls various operations, such as a print operation, purge operation, and wiping operation, based on control programs pre-stored in the ROM 92. The CPU 91 also generates various signals, such as print timing signals and reset signals, and transfers the signals to the gate array 96. The CPU 91 is connected to various devices, such as a control panel 107 that is used by a user to designate the printing or purge operation, as well as that indicates the status of the printer 1, a carriage motor (CR) drive circuit 102 that drives the CR motor 101 for moving the carriage 64, a LF motor drive circuit 104 that drives the LF motor 103 for feeding the paper sheets 62, a paper sensor 105 that detects an edge of the paper sheet 62, and a carriage sensor 106 that detects the home position of the carriage 64. Operations of the above-described devices 107, 102, 104, 105, 106 are controlled by the CPU 91. The LF motor 103 is a stepping motor in this embodiment. The number of rotation of the stepping motor is controlled by the number of input pulse signals.

The ROM 92 stores control programs for executing various operations required for the purge operation performed for the ink jet print head 6 by the CPU 91. Further, the ROM 92 stores data, such as an amount of ink filled in a new ink cartridge 61, an amount of ink consumed for one purge operation, and an amount of ink consumed for one print dot. The non-volatile rewritable memory 93 includes a remaining cyan ink counter 93*a*, a remaining magenta ink counter 93*b*, a remaining yellow ink counter 93*c*, and a remaining black ink counter 93*d* that store amounts of cyan, magenta, yellow and black ink remaining in the respective ink cartridges 61. The suction force of the suction pump 82 is changed based on the remaining ink amounts stored in the remaining ink counters 93*a*–93*d*.

Based on the print timing signals transferred from the CPU 91 and the image data stored in the image memory 95, the gate array 96 outputs print data (drive signals) for printing the image data, transfer clocks that are synchronized with the print data, latch signals, parameter signals that generate basic print waveform signals, ejection timing signals output at a certain interval. The gate array 96 transfers those signals to the carriage substrate 120 on which a print head driver is mounted.

The gate array 96 stores into the image memory 95 image data transferred from an external device, such as a computer, through a Centronics interface (I/F) 97. The gate array 96 generates Centronics data reception interruption signals, based on Centronics data transferred from, for example, a host computer through the Centronics interface 97. The Centronics data reception interruption signals are transferred to the CPU 91.

The gate array 96 includes a cyan ink consumption counter 96*a*, a magenta ink consumption counter 96*c*, a yellow ink consumption counter 96*c*, and a black ink consumption counter 96*d* that make a count for the respective color ink consumption.

The counts for the amounts of respective ink consumed during the print and purge operations are added up in the respective ink consumption counters 96*a*–96*d*. More specifically, the number of print dots is counted in the respective ink consumption counters 96*a*–96*d*, based on the print data transferred to a print head driver mounted on the carriage substrate 120. The ink consumption amount per print dot, of which data is stored in the ROM 92, is multiplied by the number of print dots counted in the ink consumption counters 96*a*–96*d* based on the print data. Thus, the amount of ink consumed during the print operation is obtained. The respective ink consumption counters 96*a*–96*d* also count the number of times that purge operations are performed. The purge operation times are multiplied by the ink consumption amount for one purge operation, of which data is stored in the ROM 92. Thus, the amount of ink consumed during the purge operation is obtained. The remaining ink amount in the respective cartridge 61 is obtained by the CPU 91 from the difference between the amount of ink filled in the new ink cartridge 61 as stored in the ROM 92, and the ink consumption amount obtained as described above. The thus obtained remaining ink amount is stored in the respective remaining ink counters 93*a*–93*d*. As the ink is consumed by the subsequent print and purge operations, the ink consumption amounts obtained based on the counts in the respective ink consumption counters 96*a*–96*d* are reduced from the remaining ink amounts stored in the respective remaining ink counters 93*a*–93*d*. Accordingly, data on the remaining ink amounts stored in the remaining ink counters 93*a*–93*d* is updated. When the ink cartridges 61 are replaced with new ones, the CPU 91 outputs a clear signal. When the remaining ink counters 93*a*–93*d* receive the clear signal output from the CPU 91, the data in the remaining ink counters 93*a*–93*d* is reset.

The carriage substrate 120 mounts thereon the print head driver (drive circuit) for driving the ink jet print head 6. The ink jet print head 6 and the print head driver are connected by a flexible printed circuit board having copper foil patterns formed on an approximately 50 to 150 $\mu$m-thick polyimide film. The print head driver is controlled through the gate array 96 mounted on the control substrate 100. The print head driver applies drive pulse waveforms appropriate for print modes to each drive element, to eject the predetermined amount of ink.

The CPU 91, ROM 92, RAM 94, and gate array 96 are connected through a bus line 99. Through a harness cable connecting the carriage substrate 120 and the gate array 96, signals are transferred therebetween.

Figure 3:
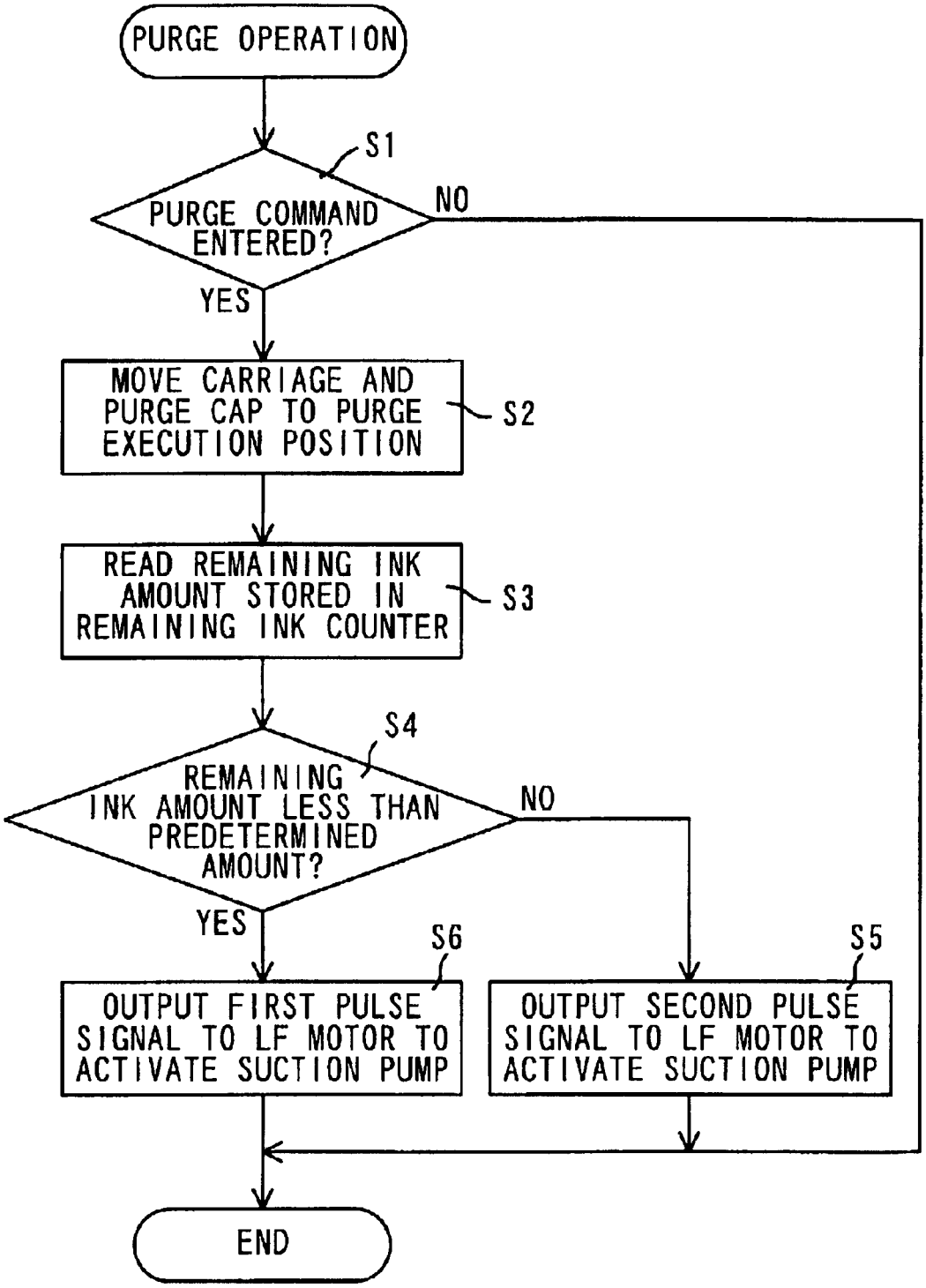
FIG. 3 is a flowchart illustrating a purge operation.

Referring to FIG. 3, the purge operation performed by the color in jet printer 1 structured as described above will be described below. First, it is determined that a purge command is entered by a user's operating the control panel 107 or automatically entered at a certain interval to perform the purge operation for specific nozzles (S1). When the purge command is entered (S1: YES), the CR motor 101 is driven to move the carriage 64 mounting thereon the ink jet print head 6 to a purge area. The LF motor 103 is connected to the cam 83 by activating the connecting mechanism. By the rotation of the LF motor 103, the purge cap 81 is moved to a purge execution position (S2). In this state, the purge cap 81 contacts the ink ejection surface 6*a* of the ink jet print head 6, forming the space enclosed with the ink ejection surface 6*a*.

Then, the remaining ink amount is read from the remaining ink counter 93*a*–93*d* associated with the color ink that is ejected from specific nozzles for which purge operation is performed (S3). It is determined whether the obtained remaining ink amount is less than a predetermined amount (S4). When it is determined that the remaining ink amount is equal to or greater than the predetermined amount (S4: NO), first pulse signals are output to the LF motor 103 (S5).

The first pulse signals output the greater number of pulses than second pulse signals, which will be described below. When the first pulse signals are output to the LF motor 103 of a stepping motor, the LF motor 103 drives the suction pump 82 with the greater number of rotation, as compared with a case where the second pulse signals are output to the LF motor 103. Accordingly, the piston of the suction pump 82 travels or moves longer, as compared with a case where the suction pump 82 is driven by the LF motor 103 based on the second pulse signals. Due to the longer distance that the piston of the suction pump 82, pressures in the enclosed area formed by the purge cap 81 and the ink ejection surface 6*a* are reduced with a relatively strong suction force. A relatively large amount of high viscous ink or air is discharged from the nozzles formed on the ink ejection surface 6*a*. The waste ink sucked along with the high viscous ink is stored in the waste ink reservoir 84. Then, the purge operation is finished.

When it is determined that the remaining ink amount read from the remaining ink counter 93*a*–93*d* is less than the predetermined amount (S4: YES), the second pulse signals are output to the LF motor 103 (S6). As described above, the second pulse signals output the smaller number of pulses than the first pulse signals. Accordingly, as compared with a case where the first pulse signals are output to the LF motor 103, the LF motor 103 drives the suction pump 82 with the fewer number of rotation, so that the distance that the piston of the suction pump 82 travels becomes shorter. That is, the suction force of the suction pump 82 activated by the LF motor 103, which is driven based on the second pulse signals, is weaker than the suction force of the suction pump 82 activated by the LF motor 103 based on the first pulse signals. In addition, the amount of ink sucked by the suction pump 82 activated based on the second pulse signals is less than that sucked by the suction pump 82 activated based on the first pulse signals. Thereafter, the high viscous ink is discharged from the nozzles by the suction pump 82, as described above, and the purge operation is finished. When the purge command is not entered (S1: NO), the flow for the purge operation ends.

As described above, in the color ink jet printer 1 according to the embodiment, when the amount of ink remaining in the ink cartridge 61 is less than the predetermined amount, the second pulse signals, which output the fewer number of pulses than the first pulse signals, are output to the LF motor 103 to perform the purge operation. Accordingly, the suction pump 82 sucks the ink from the nozzles with the weaker suction force than that exerted when the amount of ink remaining in the ink cartridge 61 is equal to or greater than the predetermined amount.

The suction force of the suction pump 82 when the amount of ink remaining in the ink cartridge 61 is less than the predetermined amount, is set to such a value that air in the ink cartridge 61 is not pulled into the ink jet print head 6. Therefore, when the amount of ink remaining in the ink cartridge 61 is less than the predetermined amount, that is, when a considerable amount of air is contained in the ink cartridge 61, the purge operation can be performed without the air being pulled into the ink jet print head 6 with the suction force of the suction pump 82. Consequently, ink can be stably ejected for the subsequent print operation.

When the purge operation is performed under a condition that the amount of ink in the ink cartridge 61 is equal to or greater than the predetermined amount, a negative pressure of, for example, approximately 50 kPa is applied to the purge cap 81 facing the ink ejection surface 6*a* having the nozzles. However, the negative pressure is reduced to approximately 3 kPa at an ink supply port of the ink cartridge 61, due to the resistance applied by an ink passage of the ink jet print head 6. Dried ink or foreign materials clogging the nozzles can be removed therefrom, or the ink ejection conditions can be recovered by the purge operation while the ink is being sucked from the ink cartridge 61 with the pressure of 3 kPa applied to the ink supply port.

The ink cartridge 61 houses a foaming material that absorbs the ink contained therein. Due to the capillary action of the foaming material, the ink absorbed in the foaming material is pulled toward a direction opposite to the ink supply port, so as to keep the ink in the ink cartridge 61. When the amount of ink remaining in the ink cartridge 61 is greater, a pressure applied to the ink supply port by the capillary action of the foaming material is smaller, for example, about 0.2 kPa. When the amount of ink remaining in the ink cartridge 61 is smaller, the pressure applied to the ink supply port by the capillary action of the foaming material is greater, for example, about 0.5 kPa.

When the amount of the ink remaining in the ink cartridge 61 is less than the predetermined amount, the pressure applied to the purge cap 81 is reduced to, for example, approximately 30 kPa from the relatively high suction force of 50 kPa, to prevent the air existing above the level of the ink in the ink cartridge 61 from being pulled into the print head 6 by the purge operation. At this time, the pressure applied to the ink supply port is little less than 2 kPa. As the pressure of approximately 2 kPa applied to the ink supply port is compared with the pressure 0.5 kPa applied thereto by the capillary action of the foaming material, the former is greater than the latter. Therefore, the ink can be sucked from the nozzles properly with the pressure of 2 kPa applied to the ink supply port.

As described above, the purge operation can be performed with the reduced suction force when the amount of the ink remaining in the ink cartridge 61 is less than the predetermined amount, while preventing the air in the ink cartridge 61 from being pulled into the print head 6 by the purge operation.

As compared with a known ink jet recording apparatus that stops the purge operation when an ink amount in an ink tank is small, the color ink jet printer 1 according to the embodiment can effectively use the ink in the ink cartridges 61 to extend the life of the cartridges, because the print operation can be continued after the purge operation even when the remaining ink amount in the ink cartridge 61 is less than the predetermined amount.

When the ink remaining in the ink cartridges 61 is reduced to less than the predetermined amount and to such a degree that the air in the ink cartridges 61 is sucked by the purge operation even with the weaker suction force, it is preferable that the purge operation be stopped even when the purge command is issued, or the print operation be stopped with an indication such as "ink empty" displayed on the control panel 107.

Because the suction force to be used when the remaining ink amount in the ink cartridges 61 is less than the predetermined amount is weaker, proper ink ejection condition may not be restored by performing the purge operation only once. In this case, a user may operate the control panel 107 to designate the purge operation once again. When the ink remaining amount is less than the predetermined amount, and the purge operation is designated at least twice using the control panel 107 during a predetermined time, it is preferable that the CPU 91 indicate the replacement of the ink cartridge 61 on the display of the control panel 107. If the ink cartridge 61 is replaced with a new one, the purge operation is performed by the stronger suction force, so that the proper ink ejection condition can be restored.

While the invention has been described with reference to the embodiments, it is to be understood that the invention is not restricted to the particular forms shown in the foregoing embodiments. Various modifications and alterations can be made thereto without departing from the scope of the invention, as set forth in the appended claims.

For example, in the embodiment, the suction forces are changed by the distances that the piston of the piston type suction pump travels. However, the suction forces may be changed using a tube type pump by controlling the number of revolution thereof In the above-described embodiment, the number of rotation of the LF motor 103 is changed based on the determination made in step S4 shown in FIG. 3, as to whether the remaining ink amount in the ink cartridge 61 is less than the predetermined amount or not, that is, based on the determination of the remaining ink amount in two classes or divisions. However, the number of rotation of the LF motor 103 may be changed according to the determination of the remaining ink amount in multiple classes. When the remaining ink amount in the ink cartridge 61 is large, the suction force of the suction pump 82 may be increased, so that the purge operation time can be reduced.

Further, in the embodiment, the remaining ink amount in each ink cartridge 61 is sequentially obtained by the difference between the amount of ink filled in a new ink cartridge 61/the remaining ink amount stored in the remaining ink counter 93*a*–93*d* and the ink consumption amount based on the counts in the respective ink consumption counters 96*a*–96*d* of the gate array 96. However, detection of the amount of ink remaining in the ink cartridges 61 only in two classes or divisions, that is, to change or not change the suction force of the suction pump 82, is acceptable according to the embodiment of the invention. Therefore, a device or method may be used other than remaining ink counter 93*a*–93*d* and the ink consumption counters 96*a*–96*d*, if the device or method may detect the remaining ink in two classes. For example, the amount of ink remaining in the ink cartridge 61 may be detected by measuring electrical resistance of ink in the ink cartridge 61 using electrodes, as disclosed in, for example, Japanese Laid Open Patent Publication No. 9-262990, or detected using an optical device, such as an optical sensor, as disclosed in, for example, Japanese Laid Open Patent Publication No. 10-24604.

In the embodiment, the number of print dots is added to the count in the respective ink consumption counters 96*a*–96*d*, based on the print data. The remaining ink amount for each color is obtained based on the counts added to the ink consumption counters 96*a*–96*d*. However, the remaining ink amount may be obtained by subsequently subtracting the number of print dots, from the number of dots that can be printed by the ink filled in a new ink cartridge 61.

The ink suction forces of the purge device 67 in the color ink jet printer 1 of an ink jet recording apparatus can be changed based on amounts of ink remaining in the ink cartridge 61. Therefore, even when the amount of ink remaining in the ink cartridge 61 is small, the suction force of the purge device 67 can be reduced, so that a proper ink ejection condition can be restored while preventing air in the ink cartridge 61 from being pulled into the ink jet print head 6 by the suction force of the purge device 67. Accordingly, in the subsequent print operation, the ink can be stably ejected, leading to the effective use of the ink.

When the amount of ink remaining in the ink cartridge 61 becomes such an amount that the air in the ink cartridge 61 will be possibly sucked with a stronger suction force, the suction force is weakened. Therefore, the air suction from the ink cartridge 61 into the ink jet print head 6 can be prevented during the purge operation. Consequently, ink can be stably ejected for the subsequent print operation and effectively used.

When it is determined that the amount of ink remaining in the ink cartridge 61 is less than the predetermined amount, the number of revolution of a drive source that drives the suction pump 82 is changed to the fewer number than that used when the amount of ink remaining in the ink cartridge 61 equal to or greater than the predetermined amount. Therefore, the suction force of the purge device 67 can be readily changed to the weaker suction force from the stronger suction force.

The amount of ink remaining in the ink cartridge 61 can be readily detected based on the ink consumption amount that can be obtained based on the counts in the ink consumption counters 96*a*–96*d*. Therefore, expensive sensors do not have to be provided for the color ink jet printer 1.

What is claimed is:

1. An ink jet recording apparatus, comprising:

an ink tank that stores ink;

an ink jet print head that performs recording onto a recording medium by ejecting the ink stored in the ink tank, the ink jet print head having an ink ejection surface on which nozzles are formed;

a purge device that recovers an ink ejection condition by sucking the ink from the nozzles formed on the ink ejection surface;

a remaining ink amount detection device that detects a remaining ink amount in the ink tank;

a determination device that determines whether the remaining ink amount detected by the remaining ink amount detection device is less than a predetermined amount; and a display that indicates an ink low condition when a user has selected a purge operation a preselected number of times while the ink stored in the ink tank is determined to be less than the predetermined amount by the determination device.

2. The ink jet recording apparatus according to claim 1, further comprising a suction force changing device that changes an ink suction force of the purge device according to the remaining ink amount detected by the remaining ink amount detection device, and wherein when the determination device determines that the remaining ink amount is less than the predetermined amount, the suction force changing device changes the ink suction force of the purge device to a second suction force from a first suction force that is used when the determination device determines that the remaining ink amount is equal to or greater than the predetermined amount, and the second suction force is weaker than the first suction force.

3. The ink jet recording apparatus according to claim 2, wherein the predetermined amount is set to such a value that air present in the ink tank may be sucked therefrom if the first suction force is used when the remaining ink amount is less than the predetermined amount, and the second suction force is set to such a value that the air in the ink tank may not be sucked if the second suction force is used when the remaining ink amount is around the predetermined amount.

4. The ink jet recording apparatus according to claim 2, wherein the purge device includes a purge cap that forms an enclosed space with the ink ejection surface of the ink jet print head, by contacting the ink ejection surface, a suction pump that reduces pressures in the enclosed space defined by the purge cap and the ink ejection surface, and a drive source that drives the suction pump, and wherein when the remaining ink amount is less than the predetermined amount, the suction force changing device changes the number of rotation of the drive source for driving the suction pump, to a second number from a first number that is used when the remaining ink amount is equal to or greater than the predetermined amount, wherein the second number is smaller than the first number, in order to change the ink suction force of the purge device from the first suction force to the second suction force that is weaker than the first suction force.

5. The ink jet recording apparatus according to claim 1, wherein the remaining ink amount detection device includes a counter that counts an ink consumption amount, and detects the remaining ink amount in the ink tank based on the ink consumption amount counted by the counter.

6. The ink jet recording apparatus according to claim 1, wherein the display indicates the ink low condition when the user has selected the purge operation at least two times while the ink stored in the ink tank is determined to be less than the predetermined amount.

7. An ink jet recording apparatus, comprising:

an ink tank that stores ink;

an ink jet print head that performs recording onto a recording medium by ejecting the ink stored in the ink tank, the ink jet print head having an ink ejection surface on which nozzles are formed;

a purge device that recovers an ink ejection condition by sucking the ink from the nozzles formed on the ink ejection surface;

a remaining ink amount detection device that detects whether a remaining ink amount in the ink tank is less than a predetermined amount;

a suction force changing device that changes an ink suction force of the purge device to a second suction force when the remaining ink amount detected by the remaining ink amount detection device is less than the predetermined amount, from a first suction force that is used when the remaining ink amount is equal to or greater than the predetermined amount, the second suction force being weaker than the first suction force; and a display that indicates an ink low condition when a user has selected a purge operation a preselected number of times while the ink stored in the ink tank is determined to be less than the predetermined amount by the remaining ink amount detection device.

8. The ink jet recording apparatus according to claim 7, wherein the predetermined amount is set to such a value that air present in the ink tank may be sucked therefrom if the first suction force is used when the remaining ink amount is less than the predetermined amount, and the second suction force is set to such a value that the air in the ink tank may not be sucked if the second suction force is used when the remaining ink amount is around the predetermined amount.

9. The ink jet recording apparatus according to claim 7, wherein the purge device includes a purge cap that forms an enclosed space with the ink ejection surface of the ink jet head print head by contacting the ink ejection surface, a suction pump that reduces pressures in the enclosed space defined by the purge cap and the ink ejection surface, and a drive source that drives the suction pump, and wherein when the remaining ink amount is less than the predetermined amount, the suction force changing device changes the number of rotation of the drive source for driving the suction pump, to a second number from a first number that is used when the remaining ink amount is equal to or greater than the predetermined amount, wherein the second number is smaller than the first number, in order to change the ink suction force of the purge device from the first suction force to the second suction force that is weaker than the first suction force.

10. The ink jet recording apparatus according to claim 7, wherein the remaining ink amount detection device includes a counter that counts an ink consumption amount, and detects the remaining ink amount in the ink tank based on the ink consumption amount counted by the counter.

11. The ink jet recording apparatus according to claim 7, wherein the display indicates the ink low condition when the user has selected the purge operation at least two times while the ink stored in the ink tank is determined to be less than the predetermined amount.

12. An ink jet recording apparatus, comprising:

an ink tank that stores ink;

an ink jet print head that ejects the ink, the ink jet print head having an ink ejection surface on which nozzles are formed;

a purge device that sucks the ink from the nozzles, the purge device including a purge cap that forms an enclosed space with the ink ejection surface by covering the ink ejection surface, and a suction pump that communicates with the purge cap;

a remaining ink amount detection device that detects whether an ink amount in the ink tank is less than a predetermined amount;

a changing device that changes a suction volume of the suction pump during an operation of the purge device, to a second suction volume when the ink amount detected by the remaining ink amount detection device is less than the predetermined amount, from a first suction volume that is used when the ink amount in the ink tank is equal to or greater than the predetermined amount, the second suction volume being smaller than the first suction volume; and a display that indicates an ink low condition when a user has selected a purge operation a preselected number of times while the ink stored in the ink tank is determined to be less than the predetermined amount by the remaining ink amount detection device.

13. The ink jet recording apparatus according to claim 12, wherein the purge device includes a drive source that drives the suction pump, and when the ink amount in the ink tank is less than the predetermined amount, the changing device changes the number of rotation of the drive source for driving the suction pump, to a second number from a first number that is used when the ink amount in the ink tank is equal to or greater than the predetermined amount, wherein the second number is smaller than the first number, in order to change the suction volume of the purge device.

14. The ink jet recording apparatus according to claim 12, wherein the display indicates the ink low condition when the user has selected the purge operation at least two times while the ink stored in the ink tank is determined to be less than the predetermined amount.

15. An ink jet recording apparatus comprising:

an ink tank that stores ink;

a recording head that ejects the ink stored in the ink tank to a recording medium, the recording head including nozzles;

a memory storing a program, the program being operable to determine whether an amount of ink stored in the ink tank is less than a predetermined amount, and to output a low suction signal if the ink amount is determined to be less than the predetermined amount and to otherwise output a high suction signal; and a purge device that purges ink from the nozzles with a level of suction force based on the signal outputted by the program, the suction force indicated by the low suction signal being lower than that indicated by the high suction signal, wherein the program outputs a signal indicative of an ink low condition for display when a user has selected a purge operation a preselected number of times while the ink stored in the ink tank is determined to be less than the predetermined amount.

16. The ink jet recording apparatus according to claim 15, wherein the memory further comprises a remaining amount indicator storing a value of the ink amount stored in the ink tank and the program continuously updates the remaining amount indicator as the ink is consumed.

17. The ink jet recording apparatus according to claim 16, wherein the program continuously adjusts the remaining amount indicator based on an amount of ink ejection and purging performed.

18. The ink jet recording apparatus according to claim 16, wherein the program continuously adjusts the remaining amount indicator based on the number of dots ejected through the nozzles.

19. The ink jet recording apparatus according to claim 15, wherein when the ink amount is less than the predetermined amount, the suction force indicated by the high suction signal is more likely to suck out the air present in the ink tank than the suction force indicated by the low suction signal.

20. The ink jet recording apparatus according to claim 15, wherein the program outputs a signal indicative of the ink low condition when the user has selected the purge operation at least two times while the ink stored in the ink tank is determined to be less than the predetermined amount.

21. A method of operating an ink jet recording apparatus having an ink tank that stores ink, a recording head that includes nozzles which eject the ink stored in the ink tank to a recording medium, and a purge device that purges ink from the nozzles, the method comprising:

determining whether an amount of ink stored in the ink tank is below a predetermined amount;

outputting a low suction signal to the purge device if the ink amount is determined to be below the predetermined amount;

outputting a high suction signal to the purge device if the ink amount is determined not to be below the predetermined amount;

purging by the purging device the ink from the nozzles with a level of suction force based on the outputted signal, the suction force indicated by the low suction signal being lower than that indicated by the high suction signal; and outputting a signal indicative of an ink low condition for display when a user has selected a purge operation a preselected number of times while the ink stored in the ink tank is determined to be less than the predetermined amount.

22. The method according to claim 21, further comprising continuously updating a remaining amount indicator based on an amount of ink used and the step of determining compares the remaining amount indicator against a predetermined amount value.

23. The ink jet recording apparatus according to claim 21, wherein the signal indicative of the ink low condition is outputted when the user has selected the purge operation at least two times while the ink stored in the ink tank is determined to be less than the predetermined amount.

* * * * *